US010332329B1

(12) United States Patent
Ekimov

(10) Patent No.: US 10,332,329 B1
(45) Date of Patent: Jun. 25, 2019

(54) SYSTEM AND METHOD FOR TRANSPARENT ELECTIONS

(71) Applicant: Serguei Ekimov, Toronto (CA)

(72) Inventor: Serguei Ekimov, Toronto (CA)

( * ) Notice: Subject to any disclaimer, the term of this patent is extended or adjusted under 35 U.S.C. 154(b) by 0 days.

(21) Appl. No.: 15/969,274

(22) Filed: May 2, 2018

(51) Int. Cl.
*G07C 13/02* (2006.01)

(52) U.S. Cl.
CPC ..... *G07C 13/02* (2013.01)

(58) Field of Classification Search
CPC ..... G07C 13/02; G07C 13/00; G06Q 10/10; G06Q 2230/00
See application file for complete search history.

(56) References Cited

U.S. PATENT DOCUMENTS 3,294,424 A * 12/1966 Mathews ..... G06K 19/00 235/489
6,250,548 B1 * 6/2001 McClure ..... G07C 13/00 235/51
2014/0231512 A1 * 8/2014 Onischuk ..... G07C 13/00 235/386
2014/0365281 A1 * 12/2014 Onischuk ..... G07C 13/00 705/12

* cited by examiner

*Primary Examiner* — Seung H Lee
(74) *Attorney, Agent, or Firm* — Elias Borges

(57) ABSTRACT

Herein is disclosed a ballot for voting in an election. The ballot consists of first and second sheets having identical voting information for recording a vote printed thereon. The first and second sheets are attached together such that the first sheet overlays the second sheet and the identical voting information of the sheets overlap precisely. The first sheet is adapted to receive a first mark recording a vote by means of a writing implement. The first sheet is a copy paper which is configured to copy the first mark onto the second sheet. The first sheet is configured to be easily detachable from the first sheet. Each of the first and second sheets have an identifier, the identifier being unique to the ballot, the identifier on each sheet being obscured by a seal overlaying the identifier. The seal is configured to be easily removed to reveal the underlying identifier.

4 Claims, 6 Drawing Sheets

SYSTEM AND METHOD FOR TRANSPARENT ELECTIONS

CROSS REFERENCE TO RELATED APPLICATION

This application claims priority from provisional application No. 62/642,186 filed Mar. 13, 2018 which is incorporated herein by reference.

BACKGROUND OF THE INVENTION

Democratic elections are based on the concept that individual voters can vote in an election, have their ballots correctly read, and have the cumulative results of the ballots tallied to determine the winner of the election. Anonymity is a key part of the process as people want to assure that they cannot be identified from the ballot they cast in the election. Furthermore, a key aspect of the democratic process is that individual voters feel confident that their ballots are accurately recorded and tallied. There is always the possibility that honest errors can be made in recording and counting the ballots. There is also the possibility that nefarious people may tamper with the ballots or deliberately misread them in an attempt to unfairly influence the results of an election. To ensure that an election is both fair and safe, a method allowing voters to safely verify that their anonymous ballots have been correctly recorded is required.

SUMMARY OF THE INVENTION

In accordance with one aspect of the present invention, herein is disclosed a ballot for voting in an election. The ballot consists of first and second sheets having identical voting information for recording a vote printed thereon. The first and second sheets are attached together such that the first sheet overlays the second sheet and the identical voting information of the sheets overlap precisely. The first sheet is adapted to receive a first mark recording a vote by means of a writing implement. The first sheet is a copy paper which is configured to copy the first mark onto the second sheet. The first sheet is configured to be easily detachable from the first sheet. Each of the first and second sheets have an identifier, the identifier being unique to the ballot, the identifier on each sheet being obscured by a seal overlaying the identifier. The seal is configured to be easily removed to reveal the underlying identifier.

In accordance with another aspect of the present invention, here is disclosed a system for voting consisting of a plurality of ballots, and means for reading, recording and displaying the votes cast. The ballots each include first and second sheets having identical voting information for recording a vote printed thereon. The first and second sheets are attached together such that the first sheet overlays the second sheet and the identical voting information of the sheets overlap precisely. The first sheet is adapted to receive a first mark recording a vote by means ofa writing implement, the first sheet being a copy paper configured to copy the first mark onto the second sheet. The first sheet is easily detachable from the second sheet, each of the first and second sheets of each ballot having an identifier, each identifier being unique to each ballot. The identifier on each sheet is obscured by a seal overlaying the identifier, the seal being configured to be easily removed to reveal the underlying identifier. One of said first and second sheets is identified as a counting ballot when marked by a vote and the remaining one of said first and second sheets is identified as a voting receipt when marked by a copy of the vote. The system includes a vote reader for reading the unique identifier and the vote for each of the counting ballot. A computer database is coupled to the vote reader for recording the vote and matching it to the unique identifier of the ballot associated with said vote. The computer database is operatively coupled to a website for displaying the votes recorded and their matching unique identifiers.

DETAILED DESCRIPTION OF THE INVENTION

Figure 1:
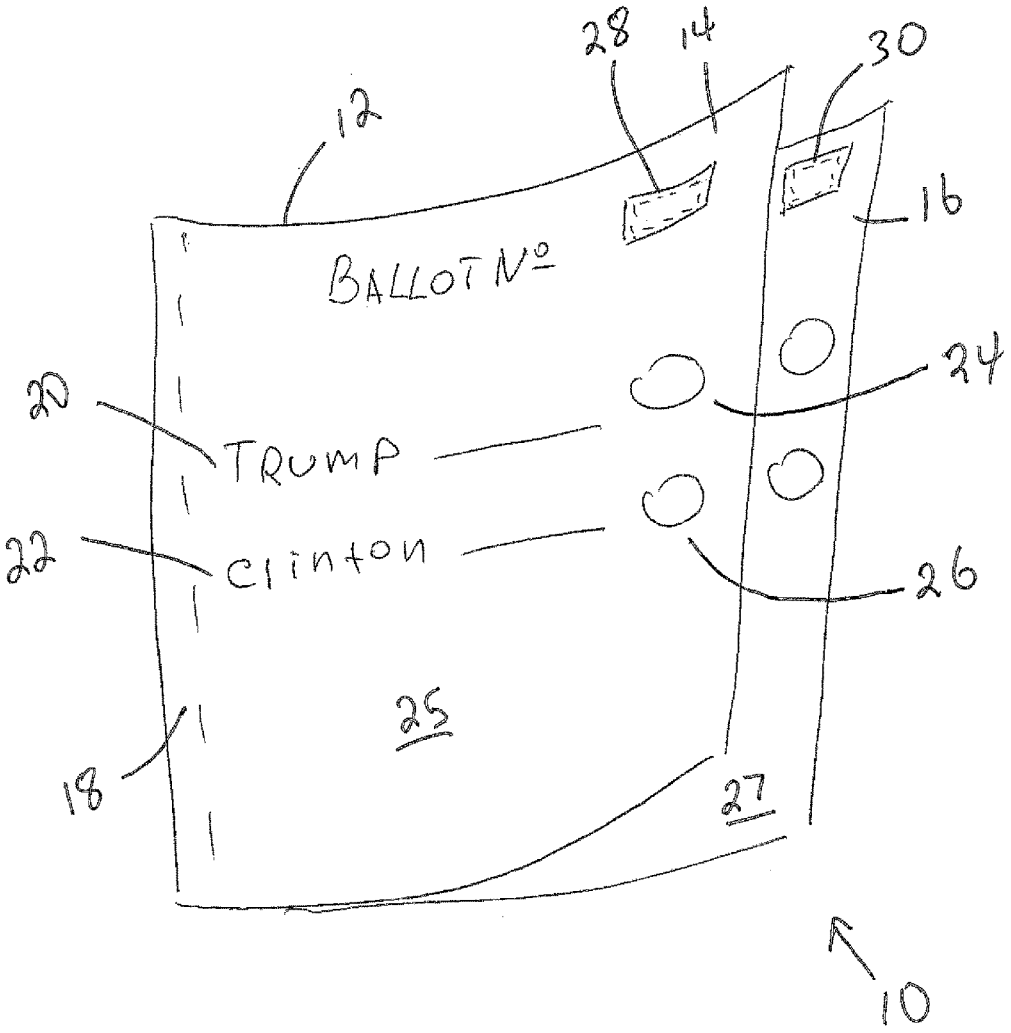
FIG. 1 is a perspective view of a hypothetical election ballot made in accordance with the present invention.

Referring firstly to FIG. 1, a ballot made in accordance with the present invention is shown generally as item 10 and consists of a small two part paper ballot 12 consisting of overlapping ballot sheets 14 and 16. Information about the election is printed onto sheets 14 and 16, including the names of candidates 20 and 22 and marking spots 24 and 26 corresponding to the name of candidates 20 and 22, respectively. Sheet 16 is an exact copy of sheet 14 which is configured to overlay sheet 16 so that the material written on sheet 14 exactly overlays the corresponding material written on sheet 16. Sheets 14 and 16 are releasably adhered to one another along spine 18 by means known generally in the art. Sheet 14 is preferably made of a carbonless copy paper having a front surface 25 which is adapted to be written on by a pen or pencil leaving an indelible mark. Sheet 14 is further configured to copy the markings made on surface 25 to surface 27 of sheet 16 in response to the voter marking sheet 14 by a pen or pencil. Since the two sheets are overlaid one on top of the other, marking surface 25 of sheet 14 causes surface 27 of sheet 16 to be marked identically. Hence, if the voter marks his or her vote on sheet 14, the same exact vote is simultaneously recorded on sheet 16. Sheet 14 is preferably made of a carbonless copy paper, although any sort of paper which is capable of copying markings onto an underlying sheet of paper can be used. Carbonless copy paper suitable for use in constructing ballot 10 are easily sourced in the marketplace for stationary and paper products. Traditional carbon paper can also be used for sheet 14; however, better alternatives capable of creating clearer and more permanent copies are available in the market.

Figure 2:
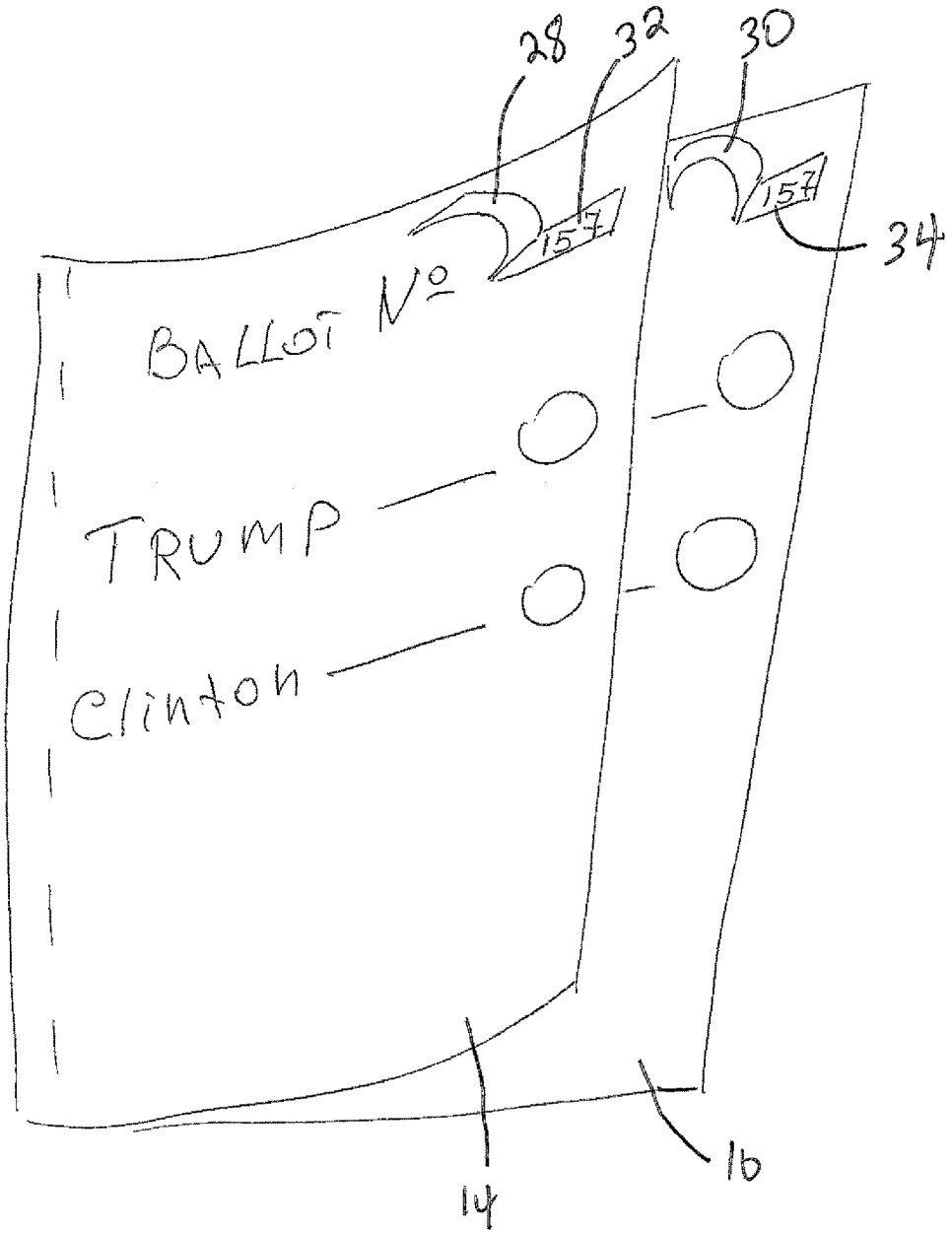
FIG. 2 is a perspective view of the ballot shown in FIG. 1 with the security seal partially removed.
Figure 3:
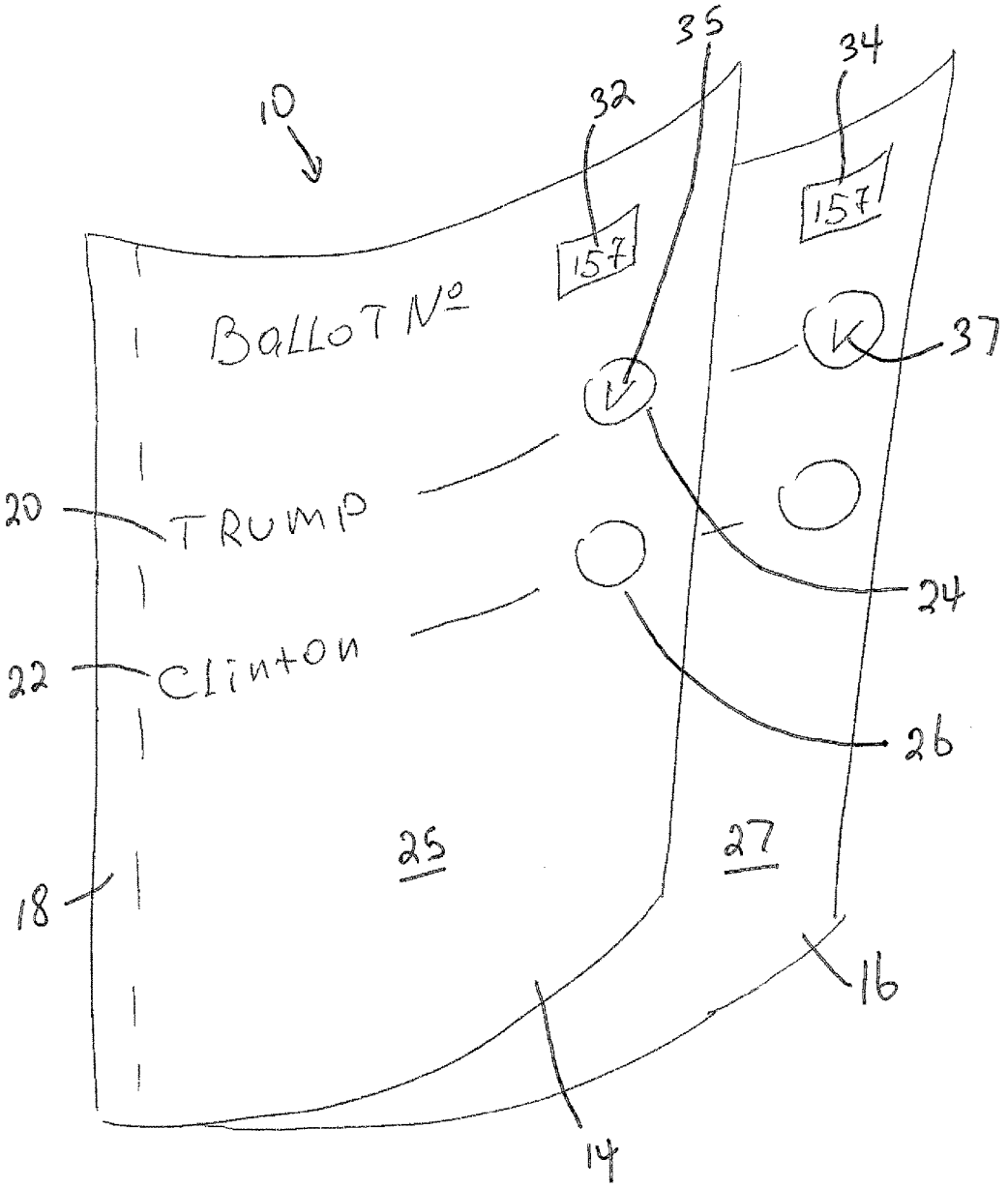
FIG. 3 is a perspective view of the ballot shown in FIG. 1 with the security seal removed and the ballot marked by the voter.

Ballot 10 is indelibly printed with a unique identifier code positioned over security seals 28 and 30. As best seen in FIG. 2, unique identifiers 32 and 34 are identical and are unique to the ballot. No two ballots would have the same unique identifier. In the example shown, the unique identifier is 157, but the unique identifier could be any sequence of letters, numbers and symbols. Security seals 28 and 30 are removable stickers which are applied to over unique identifiers 32 and 34, respectively, when the ballot is manufactured. Seals 28 and 30 preferably comprise opaque adhesive seals which are adhered to the surface of the paper and can be easily peeled away to reveal the underlying unique identifier. Alternatively, seals 28 and 30 could comprise a removable coating which obscures the underlying unique identifier, but which can easily be scratched off with a fingernail to reveal the underlying unique identifier. Methods and devices for printing a unique identifier on each ballot and then covering up that unique identifier with a removable seal are readily available in the market. As best shown in FIG. 3, the voter uses ballot 10 by peeling off the security seals to reveal unique identifier 32 and 34. Again, unique identifier 32 and 34 are identical and is unique to each ballot. The voter marks his or her vote by making mark 35 in one of the marking spots 24 or 26 on surface 25 of sheet 14. Mark 35 could be a check mark, an "X" or any other mark as required by the rules of the election. Mark 35 is made by means of a pen, pencil or some other writing implement provided by the voting station where the ballot is used. When mark 35 is made, corresponding mark 37 is simultaneously made on sheet 16 as sheet 14 transfers the mark to sheet 16. After the voter makes his or her vote, the voter detaches sheet 14 from 16.

Figure 5:
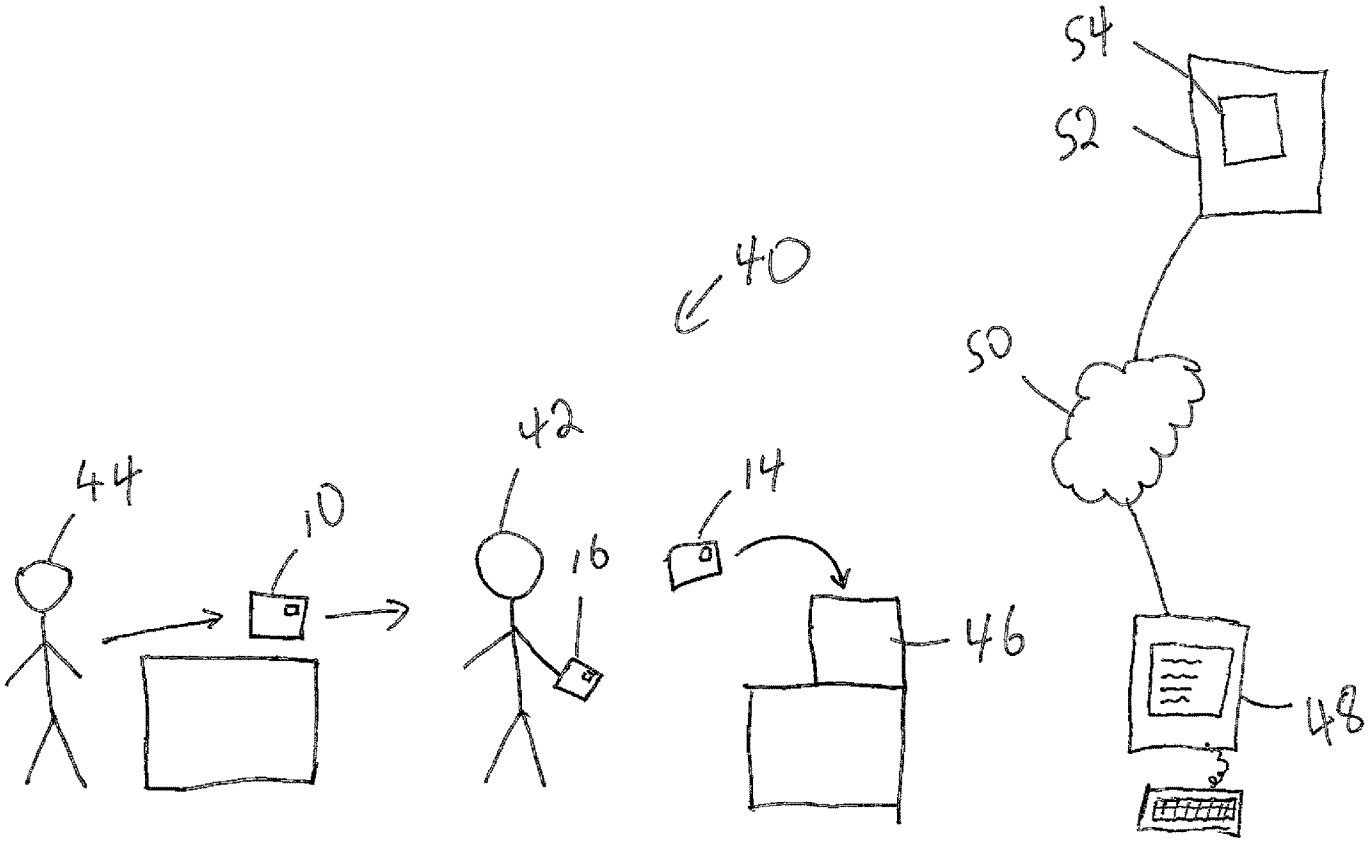
FIG. 5 is a schematic view of a voter voting in an election using the system of the present invention.

Referring now to FIG. 5, ballot 10 is used by voters in a voting station 40. Individual voter 42 identifies himself/herself to voting official 44 who checks the official records to determine if voter 42 is registered to vote at voting station 40. If voter 42 is registered to vote at station 40, official 44 hands voter 42 ballot 10. Each voter is handed a ballot, with each ballot being identical apart from the unique identifier printed on each ballot. Voter 42 then marks his or her ballot as desires and detaches sheet 14 from sheet 16. The voter then deposits one of the sheets (preferably sheet 14) into ballot box 46 and leaves the polling station. The voter retains sheet 16 as his/her confirmation of how they voted in the election. At the end of the voting period, election official 44 collects ballot boxes 46 and reads all the cast ballots. Election official 44 enters each ballot collected into computer 48 which is coupled to a central server 52 via network 50. The vote which is recorded on each ballot, together with the unique identifier for that ballot is transferred to a central database 54 located on remote server 52. Each ballot is identified in database by the ballot's unique identifier and shows the vote cast for that ballot. The actual reading of the ballots can be done manually by voting officials 44 or an automated ballot reading machine can be employed. The automated voting machine is configured to read the ballot including the vote(s) cast by the ballot and the unique identifier for that ballot. Suitable ballot reading devices which incorporate optical scanning technology to read ballots are available in the marketplace.

Figure 4:
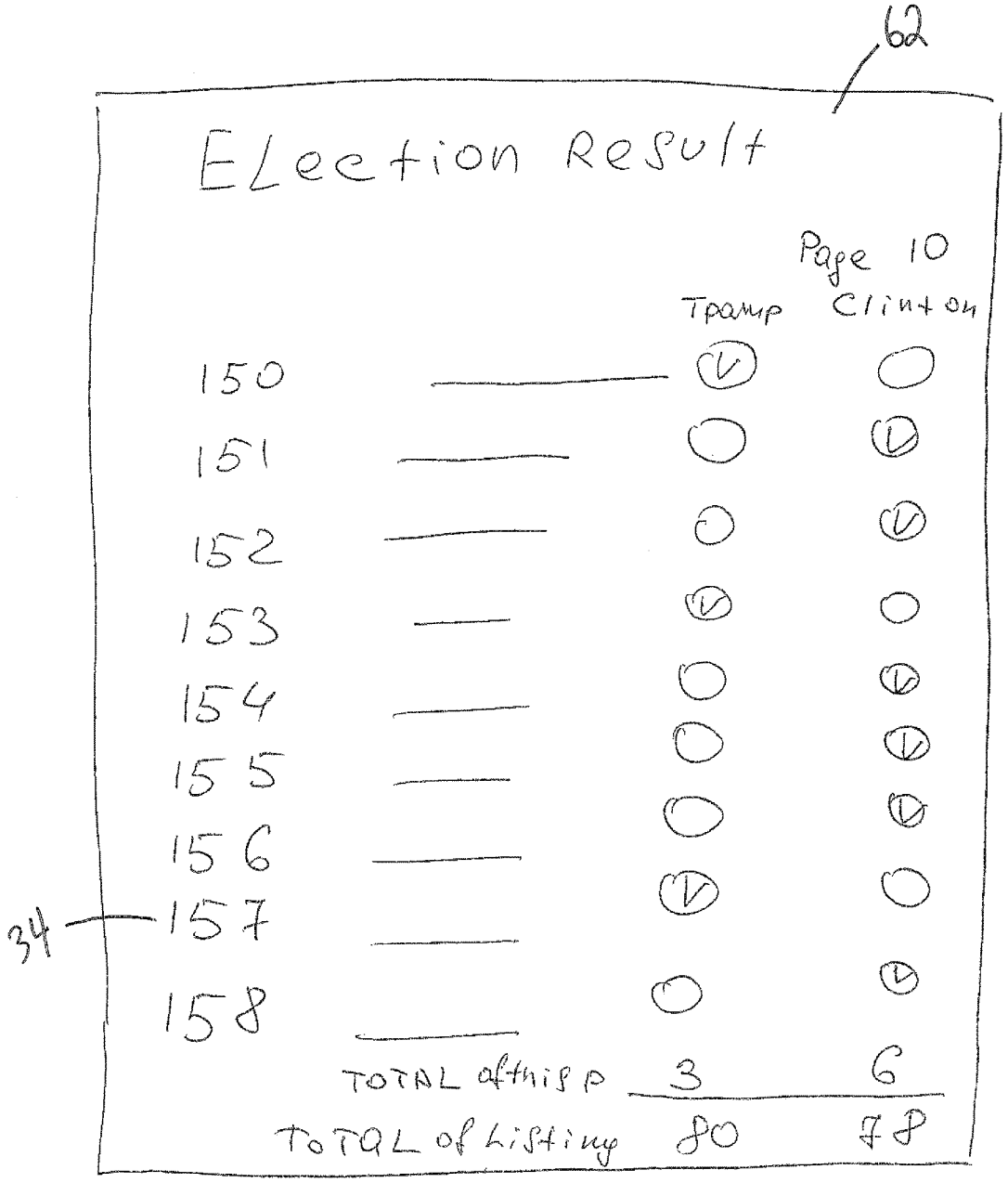
FIG. 4 is a schematic view of a page of posted election results created in accordance with the method of the present invention.
Figure 6:
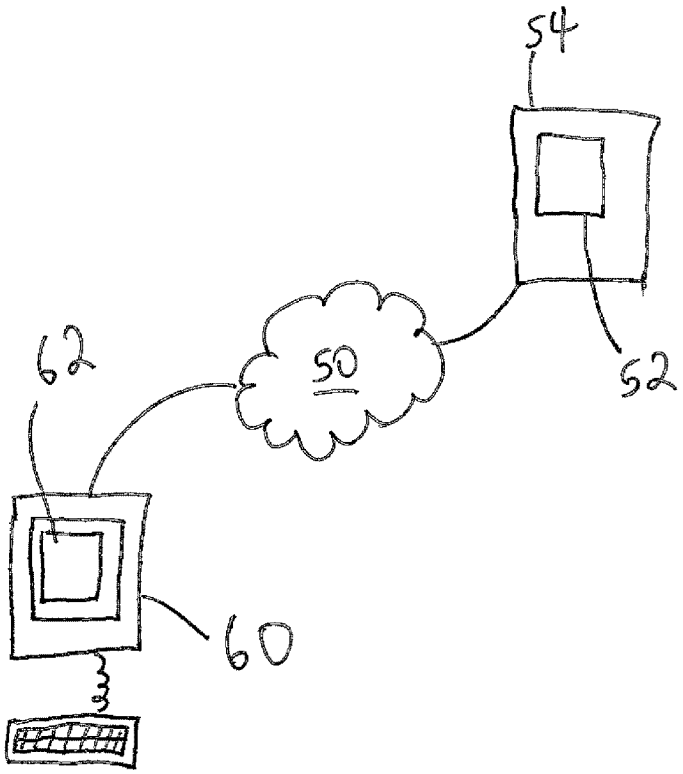
FIG. 6 is a schematic view of the vote verification system of the present invention.
Figure 6:
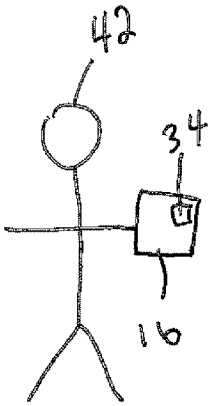

Referring now to FIG. 6, voter 42 can verify that his/her vote was correctly recorded by cross referencing his/her ballot receipt 16 with the vote recorded in central database 52 of remote server 54. Voter 42 accesses database 52 by means of computing device 60 coupled to server 54 via network 50. Computing device 60 may be a desktop or laptop computer, or it may consist of some sort of mobile computing device such as a tablet or smart phone. Network 50 is preferably the internet and database 52 is preferably coupled to a website (55) resident on (or operatively coupled to) server 54. Preferably, the website 55 is designed to permit the user to easily locate the polling station or voting district where they voted, or to otherwise find a record of the ballot cast by the voter using the ballots unique identifier code. For example, the website can be configured such that the user engages computing device 60 to call up a voting summary page 62 for the polling/voting station the voter voted in. As best seen in FIG. 4, the summary page 62 lists all of the unique identifiers for the ballots cast in the relevant polling station and summarizes how each ballot was marked. Unique identifier 34 is shown and adjacent to it is the recording of how that voter voted on that ballot. This allows the voter to quickly verify whether or not his/her ballot was correctly recorded. If there is a discrepancy, then the voter can approach the voting authorities and inform them of the discrepancy. The ballot receipt acts as proof of how the voter voted and can be used as evidence in order to fix any errors in the database.

The invention allows for voters to have increased confidence that the election results are honest and valid. Voters can verify that their ballots were recorded correctly and third party independent bodies can quickly confirm the results of elections by simply tallying the ballots displayed on the web pages of the website displaying the ballot information. The privacy of the voter is maintained because the voter's name is only checked at the polling station to verify the right to vote. The voter's name is never matched with the ballot. The voter's name is not recorded on the ballot, so only the voter will know how he/she actually voted.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A system for voting by a plurality of individual voters, the system comprising a. a plurality of ballots for voting at an election station in an election, each ballot comprising first and second sheets having identical voting information for recording a vote printed thereon, the first and second sheets being attached together such that the first sheet overlays the second sheet and the identical voting information of the sheets overlap precisely, the first sheet adapted to receive a first mark recording a vote by means of a writing implement, the first sheet being a copy paper configured to copy the first mark onto the second sheet, the first sheet being easily detachable from the second sheet, each of the first and second sheets having an identifier, the identifier being unique to each of the ballots, the identifier on each sheet being obscured by a seal overlaying the identifier, the seal being configured to be easily removed to reveal the underlying identifier, one of said first and second sheets being identified as a counting ballot when marked by a vote and the remaining one of said first and second sheets being identified as a voting receipt when marked by a copy of the vote;

b. a vote reader for reading the unique identifier and the vote for each of the counting ballots;

c. a computer database coupled to the vote reader for recording the vote and matching it to the unique identifier of the ballot associated with said vote;

d. the computer database operatively coupled to a website for displaying the votes recorded and their matching unique identifiers, e. wherein the website is configured to display all of the votes recorded at the election station as a list showing the unique identifier for each vote together with the vote recorded for the unique identifier associated with each vote, the website being further configured to permit each individual voter to view the list.

2. The system of voting defined in claim 1 wherein the first sheet comprises a carbonless copy paper.

3. The system of voting defined in claim 1 wherein the seal comprises an adhesive sticker which is configured to be easily peeled away without damaging the sheet to which the seal is attached.

4. The system of voting defined in claim 1 wherein the list is ordered sequentially based on the unique identifier and all of the votes recorded at the election station are shown in the list.

* * * * *